US005126037A

United States Patent [19]

Showalter

[11] Patent Number: 5,126,037

[45] Date of Patent: Jun. 30, 1992

[54] GEOPREATER HEATING METHOD AND APPARATUS

[75] Inventor: William E. Showalter, Seal Beach, Calif.

[73] Assignee: Union Oil Company of California, Los Angeles, Calif.

[21] Appl. No.: 518,784

[22] Filed: May 4, 1990

[51] Int. Cl.[5] ..... C10G 71/00

[52] U.S. Cl. ..... 208/370; 208/3; 137/13; 166/59; 166/60; 166/61; 166/62

[58] Field of Search ..... 208/7, 370; 137/13; 166/59-62

[56] References Cited

U.S. PATENT DOCUMENTS

| | | | |
|---|---|---|---|
| 3,087,545 | 4/1963 | O'Brien | 166/59 |
| 3,173,483 | 3/1965 | Brandt et al. | 166/59 |
| 3,216,498 | 11/1965 | Palm | 166/59 |
| 3,410,347 | 11/1968 | Triplett et al. | 166/59 |
| 3,420,300 | 1/1969 | Todd | 166/59 |
| 3,620,300 | 11/1971 | Crowson | 166/60 |
| 3,975,617 | 8/1976 | Othmer | 219/300 |
| 4,466,484 | 8/1984 | Kermabon | 166/60 |
| 4,472,621 | 9/1984 | Blackmore | 219/301 |
| 4,648,964 | 3/1987 | Leto et al. | 208/390 |
| 4,716,960 | 1/1988 | Eastlund et al. | 166/62 |
| 4,778,586 | 10/1988 | Bain et al. | 137/13 |
| 4,818,371 | 4/1984 | Bain et al. | 208/7 |
| 5,008,085 | 4/1991 | Bain et al. | 166/59 |

OTHER PUBLICATIONS

"Electrical Method Heats Long Pipelines," by N. B. Carson, Abridgement of Paper 74-PET-35, Presented in 1974.

"RTA Geotreater (TM) Process," Presentation of the Superior Alternative for Transportation of Heavy Crudes Resource Technology Associates, Sep. 1987).

"Skin Effect Tracing Provides Accurate Temperature Control in 1350 Insulated Pipe-line," Mid-Apr. 1979, Chemical Processing, pp. 70-71.

"New Technology Seeks to End Pipelines Heavy Crude Diluent," Oil and Gas Journal, May 30, 1982, p. 4D.

*Primary Examiner*—Helane Myers

*Attorney, Agent, or Firm*—Gregory F. Wirzbicki; William O. Jacobson

[57] ABSTRACT

A separate heat source, such an a skin effect heater, is added to a subterranean heat exchanger and oxygen combustion device for upgrading viscous crude oil feeds. An insulated wire is integrated with combustion oxygen supply piping to form the skin effect heater operating in conjunction with the heat exchanger. The separately controlled heater output allows a reduction of the heat from the combustion device reduced quantities of combustion products. The improvement downsizes or eliminates excess combustion product removal facilitates and also preheats the oxygen supply. The skin-effect heater and heat exchanger combination adds heat gradually and increases feed residence time at the desired upgrading temperature and pressure conditions. Alternative embodiments cna be used to treat heavy crudes within a producing well.

15 Claims, 2 Drawing Sheets

GEOPREATER HEATING METHOD AND APPARATUS

FIELD OF THE INVENTION

This invention relates to oil production devices and processes. More specifically, the invention is concerned with providing a device which treats heavy oils to reduce viscosity and improve transportability.

BACKGROUND OF THE INVENTION

Many hydrocarbon resources (i.e., heavy crude oils and tar sand fluids) and residues (i.e., bitumen) are non-free flowing materials. Some of these resources are also found in remote areas of Canada and Alaska, requiring transportation over long distances (i.e., hundreds of kilometers). These viscous resources present significant challenges to economic recovery and transportation to a refinery and/or the consumer.

The high viscosity of many heavy crudes or other feeds make transportation by conventional pipeline methods nearly impossible without process treatment. Treatments are needed to change at least the viscosity of the transported crudes. Treatments have included dilution with lighter components such as condensate, transporting them in heated pipelines, and upgrading (e.g., partial thermal cracking or refining under elevated temperature and pressure conditions). However, all of these treatments are costly.

Lighter components for dilution may not be available or economic to transport to a remote site. Heating for long distances requires large insulation and fuel costs, especially in cold climates. Although upgrading can also decrease refining costs, it typically requires costly surface facilities, such as heavy wall pressure vessels, and requires continual operational expenditures. Because of these costs, the often remote location, large uncertainties of well production, and the finite life of productive wells, the economic development of many remote heavy crude reserves has not been accomplished.

An upgrading alternative to high temperature and pressure containing surface facilities (e.g., large, heavy wall surface vessels) is a Geotreater TM process, developed by Resource Technology Associates. The Geotreater TM process places a long, concentric tubular unit within a deep (e.g., approximately 1500 meters or 5,000 feet) borehole, adding heat under high downhole pressures to thermally crack viscous components and upgrade these feeds. The weight of down-flowing crude (near the bottom) replaces costly high pressure pumps.

The process chemically and physically alters (i.e., partially upgrades or thermally cracks) the pressurized feed stream to achieve a lower viscosity product. A downhole combustion make-up heat source is provided by an oxidizer supply pipe and downhole oxidizing reaction/combustion. A portion of the downhole heating transferred to the product stream is recovered by the down-flowing feed stream in the long tubular unit acting as a concentric tube heat exchanger. The earth around the borehole (i.e., formation) is also normally a good thermal insulator. This combination of regenerative heating (i.e., product stream heat transferred to feed stream), low pressure pumping requirements, and low thermal losses once the process is stabilized (approaching an adiabatic process except for make-up heat), result in minimal down-hole make-up heating and high efficiency. In pilot unit testing, reductions in viscosity of as much as two orders of magnitude, as well as increases in API gravity, pour point reductions, and increased residuum conversion were achieved without significant coking.

A critical control aspect of the Geotreater TM process is the downhole make-up heating (e.g., combustion). This must be accomplished in a manner which minimizes residence time (and resulting cost), but also avoids excessively rapid heating. Control of make-up heating can be accomplished by temperature based control of injected oxygen pressure and quantity. Injection and combustion typically occur in the unit after the down-flowing feed stream makes a U-turn near the bottom and begins its upward flow. Oxygen must also be carefully controlled to be well mixed to avoid hot spots.

The post-combustion temperature is controlled to avoid forming significant amounts of coke. Coke is a carbonaceous material which precipitates from feed, such as bitumen. Coke precipitation reduces the yield of high value refined hydrocarbon products and can cause scale, pumping, erosion and other problem which derive from the presence of a solid component in a flowing fluid.

The combustion heat and pressure upgrade the crude, but water, carbon dioxide, hydrogen and other combustion or reaction products are also formed in the product stream. Some of these combustion products may participate, further react, or otherwise assist in the upgrading, but combustion products may also destabilize the lower viscosity product stream.

Water may also be present in the crude oil source and/or may be added to the feed stream for temperature, pressure, and process reaction control. Although some of these addition/combustion products may be useful in upgrading the feed stream, excessive amounts (i.e., amounts which destabilize the crude oil product stream) must be removed prior to pumping and transport within a pipeline. Coke, sulfur, and other undesirable products in the discharge or product stream may also have to be removed to stabilize the product stream. Sulfur can be removed by a Claus process and tail gas unit. Post-combustion stabilization and combustion product removal are typically accomplished at on-site surface facilities. The stabilized product stream can then be economically transported and refined.

The necessity to stabilize and remove excessive water, gases, and other products adds significant capital and operating costs and risks to the Geotreater TM process. Since different feed streams require different heating and produce different combustion products, these removal facilities must also be sized for various quantities even if the feed stream throughput is fixed. Startup, process upset conditions, and non-uniform combustion further complicate the design and operation of these surface facilities. These factors can also create temperature control problems and result in excessive coking at critical areas.

None of the current Geotreater TM approaches known to the inventor eliminates the problem of significant on-site facilities to stabilize and remove excessive quantities of water, gases, and other products. In addition, combustion control problems and increased cost result from coking at critical areas.

SUMMARY OF THE INVENTION

Such problems are avoided in the present invention by an integral source of make-up heat added to the current Geotreater TM process. The added source can be obtained from an insulated wire added to a Geotreater TM unit's oxygen supply pipe to form an integrated skin-effect heater. The wire is run inside oxygen supply piping which now also functions as a heat trace and oxygen pre-heater. This improved apparatus gradually adds a portion of the make-up heat to a viscous feed stream and an oxygen stream so that reduced quantities of oxygen are needed and process conditions are better controlled. The reduced amount of oxygen produces less destabilizing combustion products requiring removal prior to pipeline transport.

The skin effect heater gradually adds make-up heat while the feed stream is slowly flowing down the improved unit. The heating extends the residence time at elevated temperatures without increasing the size of the unit. The separate control of combustion product generation and heat generation of the present invention convert the process to one which is tolerant of various feed stock compositions and off-design process conditions.

The improvement results are a gradual and controlled heating which reduces coking at critical areas and down-sizing or elimination of on-site stabilizing facilities. An alternative embodiment also allows the unit to be placed into a producing well.

BRIEF DESCRIPTION OF THE DRAWINGS

In these Figures, it is to be understood that like reference numerals refer to like elements or features.

DETAILED DESCRIPTION OF THE INVENTION

Figure 1:
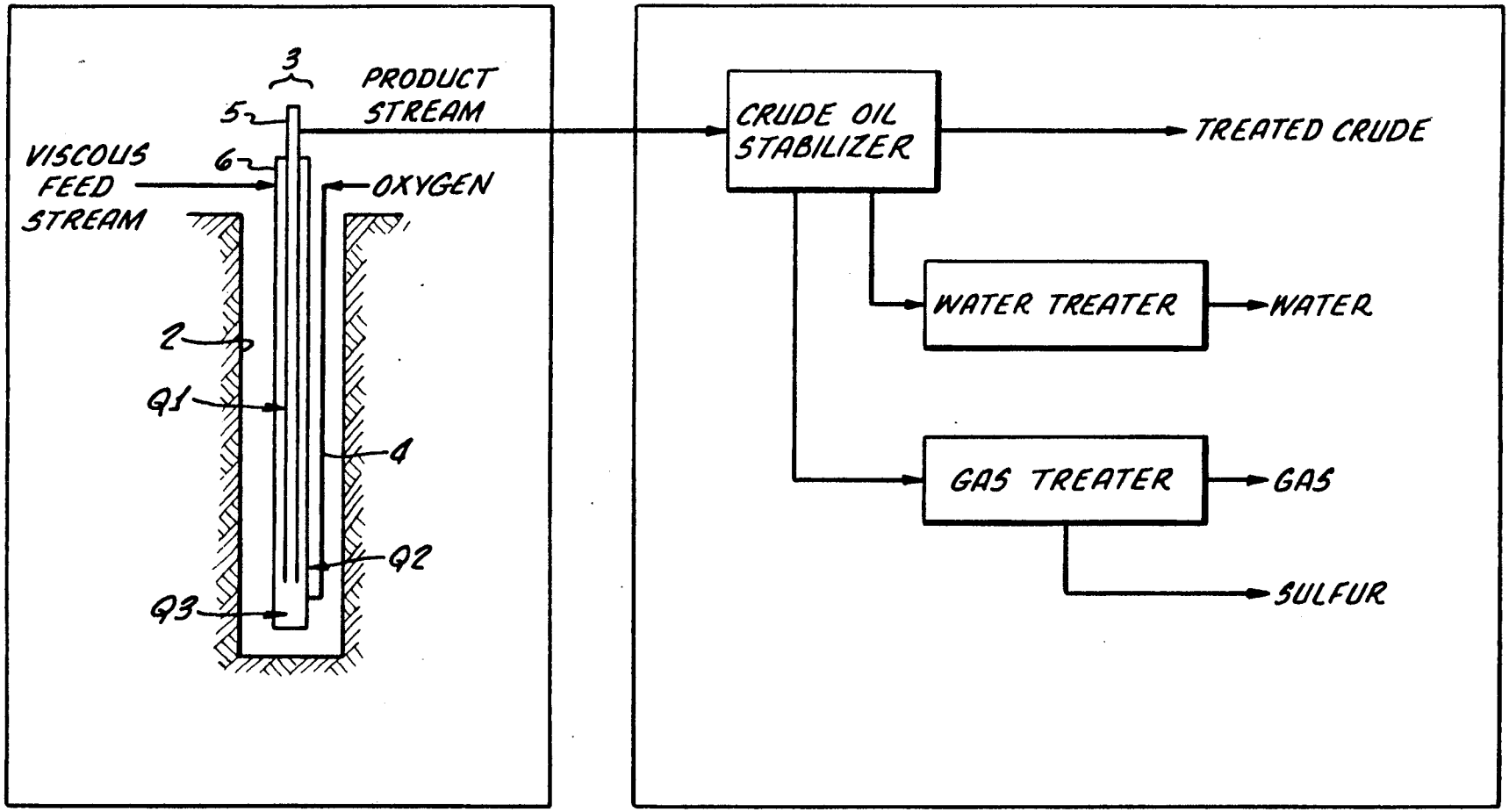
FIG. 1 shows a schematic of an improved Geotreater TM process.

FIG. 1 shows a borehole or cavity 2 in the earth (i.e., a subterranean formation) into which an improved Geotreater TM unit 3 is inserted. The borehole 2 can be an abandoned or non-producing well, at least about 2,000 feet (approximately 610 meters) deep, preferably about 4,000–5,000 feet (approximately 1200–1500 meters) deep. In the preferred embodiment, the improved Geotreater TM unit 3 is a concentric tubular heat exchanger device about 4,000–5,000 feet (approximately 1200–1500 meters) long which heats and pressurizes a viscous hydrocarbon feed stream at depth to produce a less viscous product stream.

The pressure on the viscous feed within the unit's annulus is increased in a downflowing stream. The increasing pressure is caused by the fluid feed (i.e., hydrostatic) head developed as the feed moves down the unit 3, less frictional losses. While downflowing, the feed stream is also heated by two sources, assuming frictional heating is not significant. A first heat quantity "Q1" indirectly heats the feed by heat transferred from the hot product stream source flowing up the center tube. A second heat quantity "Q2" heats the feed from an externally supplied energy source or electric heater, preferably an induction or skin-effect heater. Under elevated pressure and temperature near the bottom of the unit, the feed stream is mixed with an oxygen stream from oxygen piping 4 and oxidized/reacted. The combustion/reaction adds another quantity or increment of heat "Q3." The oxidation, heat addition, and pressure creates thermal cracking conditions which reduce the viscosity and create a hot product stream. The product stream is then cooled (i.e., heat transferred from the product stream to the feed stream) and pressure reduced as it moves up tubular unit 3. The product stream is then transferred to surface support facilities (shown within a separate box) which stabilize the product and remove unwanted components and combustion products, such as excess sulfur, water and gas. The recovered product is a transportable treated or upgraded hydrocarbon fluid.

The viscous feed stream, such as dehydrated heavy crude oil, is typically supplied from nearby production wells and upstream production facilities (not shown for clarity). Upstream production facilities may separate and remove other unwanted components, such as brine and gases, from the heavy crude feed stream. The upstream separated components may be injected into the formation for the purposes of product recovery and disposal of unwanted constituents. The feed stream may also be heated to above ambient temperature conditions, especially if steam flood or other thermal recovery methods are involved upstream. The feed stream is typically transferred to the unit 3 by means of a low pressure transfer pump (not shown).

If the unit 3 has a diameter of significantly less than the borehole 2, it is typically concentrically placed spaced apart from the borehole 2, as shown in FIG. 1. However, the exterior tubing of larger improved Geotreater TM units may also be a casing/lining string cemented into the adjoining borehole 2 as an alternative construction. For a capacity of 10,000 bbl/day (approximately 1,100 liters/minute), a representative unit 3 would have a diameter of about 15 inches (approximately 38 cm).

Unit 3 is tubular, composed of concentric inner and outer tubing strings 5 and 6. The tubing strings are preferably composed of heat and corrosion resistant materials and act as a long concentric flow, countercurrent heat exchanger. The heated product stream rising in the inner tubing string gives up heat to the down-flowing feed stream in the annular space within the outer tubing string. Because of heat losses to the formation, finite temperature difference required to transfer heat, and/or heat consuming reactions, this first or regenerative heat increment "Q1" added to the down-coming feed stream by heat exchange with the upcoming product stream cannot fully heat the product stream to the required viscosity reduction temperature. In addition, heat transfer per unit exchanger area tends to be low due to the length and size of the unit 3 required to obtain the needed hydrostatic pressures, i.e., additional heat could be added/transferred within a unit of this size and duty with little reduction in thermal efficiency.

In accordance with the invention, an electric heater, such as a skin effect heater (see FIG. 2), is integrated into at least a portion of the unit 3 tubulars. The skin effect heater adds a second increment of heat, as shown by "Q2" in FIG. 1, to the down-coming feed stream. The skin effect heater preferably extends the entire length of unit 3 to maximize the gradualness and efficiency of the heating, but alternative embodiments may add a heater to only a portion of unit 3.

The second or skin-effect heat increment "Q2" occurs in conjunction with at least a portion of the first increment "Q1" provided by the heat exchanger (i.e., "Q1" is added during addition of "Q2"). This combining of a heater with a heat exchanger can lower or even reverse the efficiency of the heat exchanger. Lower efficiency would reduce the quantity of the first heating increment "Q1" and increase the make-up heating required (i.e., second and third increments heating "Q2" and "Q3"). However, if the skin effect heater is properly placed (e.g., outboard of inner tubing's heat exchange surface area) and heat is supplied gradually to the down-coming fluid in a long unit, as in the preferred embodiment, the effect of second heat increment "Q2" upon the first heating increment "Q1" can be made insignificant.

In general terms, a skin-effect heater primarily heats by an interaction between proximate parallel elements, an alternating current within a first conductor element, such as copper wire, and the flux linkages surrounding it in a proximate conductive element, such as a small diameter steel pipe. These linkage effects concentrate near the surface or skin of the pipe. The alternating current is typically impressed on the copper wire by a controllable electrical power supply. A small portion of the heat added is also provided by the resistance of the copper conductor.

Figure 2:
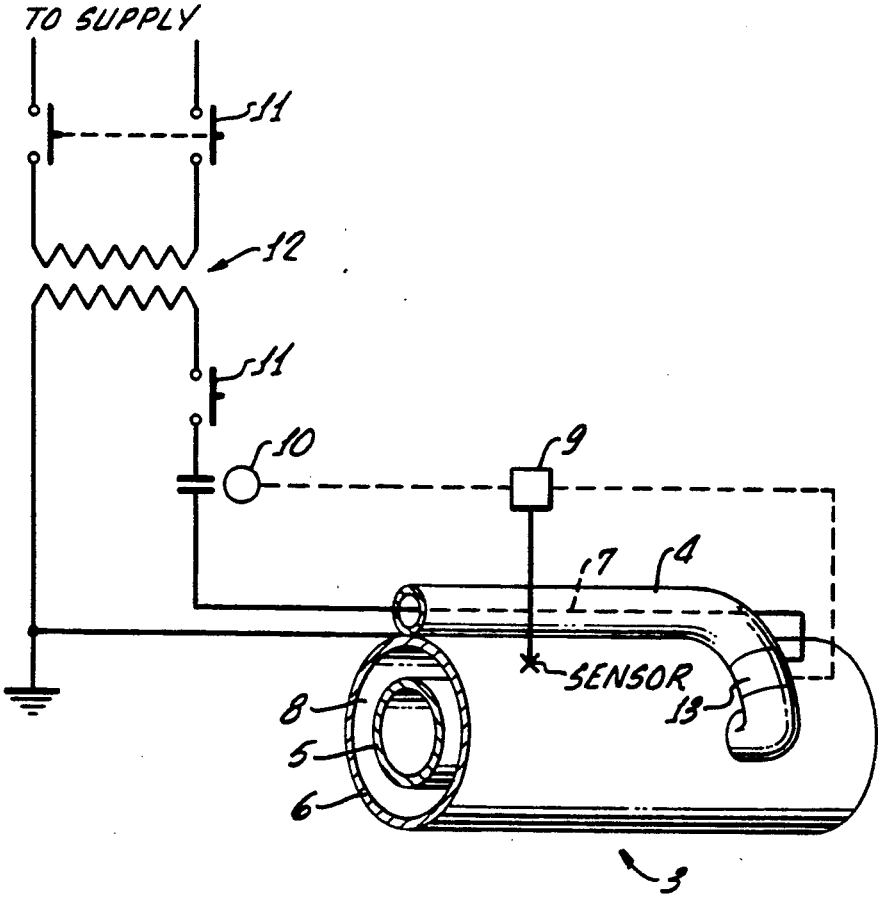
FIG. 2 shows an orthogonal view of an improved Geotreater unit section and a control schematic of a skin effect heater.

The heat increment "Q2" generated by the skin-effect heater is a gradual heat addition along the length of the heat exchanger. As shown in FIGS. 1 and 2, the preferred embodiment uses the proximate small diameter steel pipe 4 which would otherwise only carry the oxygen downhole.

The final heat increment, "Q3," is provided by the supply, mixing and combustion/reaction of a pressurized oxidizing fluid, such as the oxygen source and piping 4 shown in FIG. 1, with the hydrocarbon or other oxidizer reactive feed stream. In the preferred embodiment, oxygen supply piping 4 is outside the concentric tubular heat exchanger of unit 3, but is attached to the tubulars and within the borehole 2 which allows it to act as outer tubing heat tracing. In the preferred embodiment, the skin effect heater replaces a portion of the combustion heat otherwise required for make-up heating, reducing the quantity of oxygen otherwise required. The reduced quantity of oxygen produces reduced combustion products, such as $H_2O$ and $CO_2$, and a reduced quantity of make-up heat "Q3" at downhole pressure. The combination of heat increments and combustion products added to the feed stream under the downhole pressure environment reduces the viscosity of the feed stream.

In the preferred embodiment, all of the piping and tubing strings are composed of ferrous materials, such as temperature and corrosion resistant steels, in which eddy or skin effect currents can be induced. The eddy currents are preferably induced in the oxygen supply piping 4, which is welded or otherwise thermally coupled with the outer tubing string 6.

A viscosity reduction zone occurs near the final heat increment "Q3" (see FIG. 1). The feed stream conditions/properties are controlled within the zone to accomplish the viscosity reduction. Means for control typically include temperature sensors, controllers, and actuators (see FIG. 2) to maintain the desired viscosity reduction temperature conditions. Temperature sensors are attached to the tubulars, and the oxygen supply is controlled by a remotely operated valve 13 (see FIG. 2). Other viscosity reduction zone controls can include pressure sensors and pumping controls, flow sensors and restrictors, and other electrical skin-effect heater controls.

Elevated fluid temperature in the viscosity reduction zone is controlled to within a range which will reduce viscosity under the high downhole pressures and combustion conditions. Although there is no theoretical minimum control temperature (i.e., each feed stream will require different conditions), a typical minimum temperature to achieve significant viscosity reduction is 250° C. Correspondingly, there is no maximum control temperature, but significant coking can occur in some feed streams above about 500° C. and controls can be set to prevent exceeding this maximum temperature within the zone. Typically, the zone is temperature controlled from above about 300° C. (572° F.) to less than about 415° C. (779° F.).

In the preferred embodiment, the feed temperature and pressure rises gradually as the fluid feed flows down the skin-effect heater and heat exchanger. Temperature may rise nearly linearly from near ambient to the maximum temperature in the zone. Pressure is a function of the depth, heated feed stream density, and flowrate pressure losses. Although the minimum and maximum pressures are essentially unlimited, pressure with the viscosity reduction zone is typically controlled to with a range from above about 1000 psig (approximately 69 atmospheres) to less than about 3700 psig (approximately 250 atmospheres), more preferably from 1700 to 2200 psig (approximately 117 to 151 atmospheres). Residence time is generally less than 30 minutes.

An alternative process configuration is to provide preheating of the feed stream at the surface or in conjunction with upstream processes (not shown for clarity). Preheating can occur before, at, and/or after the transfer pump, or during upstream production/recovery operations. The preheating can improve the gradualness of heating.

In another alternative configuration and process, at least a portion of the second heat increment "Q2" is added after combustion heat addition "Q3" and the accompanying generation of combustion products. This can enlarge the viscosity reduction zone further downstream and extend residence time. Post-combustion heating allows improved temperature control by allowing combustion hot spots to dissipate prior to reaching final viscosity reduction temperatures. In this alternative configuration, oxygen injection may also be moved upstream (i.e., placed in the down-coming stream). Thus, in alternative embodiments, a single or multiple skin effect heaters can provide heat quantity "Q2" to the feed stream prior to, during and/or after the other heat additions "Q1" and "Q3" as desired. A modified configuration can delay ignition/full reaction of the oxygen after injection and mixing, but before before the feed leaves the reaction zone.

The product stream is cooled and depressurized as it rises in the counter-current heat exchanger of the unit 3. Ideally, the recovered product stream does not require stabilization, if upstream pre-treatments (such as dehydration), combustion, and heat additions are optimally controlled. However, some surface support stabilization facilities, shown in FIG. 1 as a box around product stream processes, may be required or cost effective prior to pipeline transport. Excess gas and water may be separated by gravity in quiescent vessel(s). Sulfur removal may require additional treatment processes, such as a Claus process. The stabilized or upgraded product stream recovered can be pipeline transported for long distances without further treatment.

An orthogonal cross-sectional view of a skin-effect type of heater section of unit 3 and a schematic of heater controls is shown in FIG. 2. The section shown in FIG. 2 is proximate to the near bottom of unit 3 as shown in FIG. 1. In the embodiment shown, the oxygen supply piping 4 acts as a small diameter heat tracing in thermal contact with the outer tubing string 6. The skin effect heating is accomplished by impressing an electrical alternating current from a power supply (not shown for clarity) through various controls to an insulated conductor or copper wire 7 within oxygen piping 4. The oxygen piping 4 is electrically grounded at or near the surface and attached to the copper wire 7 at or near the bottom of unit 3. If skin effect heating is not desired over a portion of the unit 3, the copper wire is separated or otherwise electromagnetically isolated from the steel oxygen piping and tubing so that electromagnetic field interaction is minimized.

The grounded piping 4 of the skin effect heater typically ranges from ½ to 1¼ inch nominal (diameter) sizes, but other sizes can be used. Schedule 40 pipe can be used for small diameter, low differential pressure applications, but other wall thicknesses are also possible. Copper wire typically ranges from AWG No. 10 to AWG No. 20, but other materials and sizes can be used. Wire insulation must be selected to withstand the oxygen environment and elevated temperatures. The induced electrical eddy currents and skin effects (and the resistance of the copper wire) generate small quantities of heat over unit lengths of the oxygen pipe 4, typically no more than 10 BTU/foot/minute, preferably no more than 2 BTU/foot/minute. The heat is primarily transferred from the grounded piping 4 to either the down-coming feed stream in annulus 8 (see FIG. 2) or the oxygen flowing down the oxygen pipe 4. A portion of the heat is also typically lost to the formation 2 (see FIG. 1).

Alternative heaters, locations and configurations are also possible. A separate heat tracing pipe may be used for portions of the skin effect heater, separate from the oxygen supply pipe. The outer tubing 6 may be grounded and the copper wire placed within the annulus 8, inductively heating at least a portion of the nearby outer tubing 6. The copper wire can also be placed within a grounded inner tubing string 5 to heat both the down-coming and upcoming streams. The wire 7 and oxygen pipe 4 can also be placed within the annulus 8 without any attachment to the inner or outer tubing string, heating the feed stream directly, or the oxygen supply piping 4 can also be attached to either the inner or outer tubing strings. If heating of only the upcoming stream is desired (e.g., post combustion heating), oxygen piping 7 can be placed unattached within the inner tubing, or if attached to the inner tubing string 5, can have an insulating layer applied to the outer surface of the tubing 5.

The skin effect heater is controlled by a relatively simple on-off temperature controller 9 as shown schematically in FIG. 2. The temperature controller 9 detects the temperature of the wall of the outer tubing string 6 and, if temperature is insufficient to achieve viscosity reduction, controller 9 closes the electrical circuit by means of contactor 10. When temperatures are detected which approach coking conditions, the electrical circuit can be opened by means of contactor 10 and/or oxygen injection quantities/flow can be reduced by means of an oxygen control valve 13. Additional control of the skin effect heater and temperature is provided by circuit breakers 11 (e.g., over-temperature cut-off) and transformer 12 (e.g., voltage control to alter the quantity of heat added per foot of pipe.

The copper or other low resistance material wire 7 can also be used to actuate oxygen control valve 13, as shown in FIG. 2. This combined function of wire 7 may be affected by a DC voltage level shift (to actuate valve) impressed upon an AC voltage (for heating) or an AC source capable of shifting frequency may be used for actuation and heating. Alternatively, the wire can be attached to the oxygen piping 4 near the bottom of the unit 3 if only a heating is desired for the wire 7.

A major benefit of replacing a portion of the combustion heat with a separate skin effect heater is the gradualness of the heat addition. Although it is not completely understood why gradual heat addition under these pressures produces beneficial upgrading results for certain feed streams, less coking is expected to result. This benefit can offset the loss, if any, of regenerative heat transfer efficiency in the tubular heat exchanger.

Stream or strip heaters, spot resistance heaters, multiple insulated copper wires, other controls, and other power sources can also be provided in alternative embodiments. Placement of these alternative or added heat sources can selectively provide initial heating for startup, compensate for external heat losses, control preheating of oxygen and/or feed stream, and add the final increment of heat to bring the feed stream to viscosity reduction temperatures after combustion.

Figure 3:
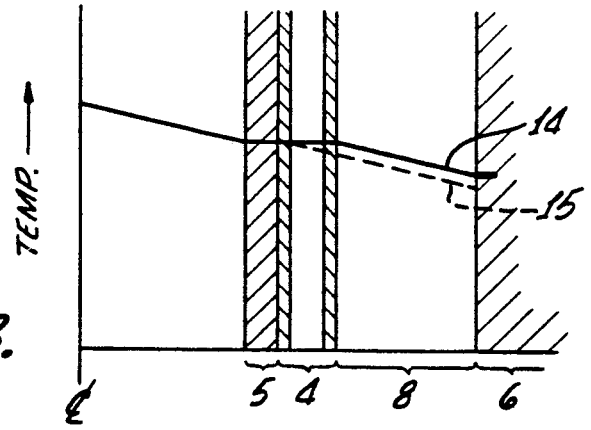
FIG. 3 shows a graph of temperature across a section of an alternative configuration.

FIG. 3 illustrates the temperature performance of an alternative configuration of the present invention. This alternative embodiment is similar to that shown in FIG. 2, except the oxygen piping 4 is within the annulus 8 and is attached to the inner tubing 5, rather than attached to the outside of outer tubing 6. Temperature across ½ of a section (radially outward from inner tubing centerline) near the bottom of the alternative configuration unit is depicted. Since heat is transferred from high to lower temperature materials, the hot rising hydrocarbon stream within inner tubing string 5 is giving up heat to the walls of the inner tubing string 5, as shown by the solid outwardly decreasing temperature line 14 approaching the interior wall of the inner tubing string 5.

Since the resistance to heat transfer by the tubing walls is normally small (i.e., high thermal conductivity of tubing materials), the temperature difference across the tubing wall is therefore shown as nearly flat. Further outward, the relatively small increment of heat added per foot by the skin effect heater directly operating on the high conductivity walls of oxidizer piping 4 is rapidly removed by the cooler down-flowing stream. This is shown by the slowly decreasing or nearly flat solid temperature line 14 outwardly across the oxidizer piping 4 and rapidly decreasing line 14 segment radially outward from the oxidizer piping 4. Essentially all of the heat from the upcoming product stream and the skin effect heater is dissipated into the down-flowing feed stream within the annulus 8, as shown by the temperature of solid line 14 decreasing radially outward from the oxidizer piping 4.

For comparison, dotted line 15 shows the temperature distribution without the skin effect heater in place or operating. The combustion heat quantity "Q3" (see FIG. 1) has been increased to compensate for the loss of the heat added by the skin effect heater; thus the temperature of the upcoming stream near the bottom of the unit is shown essentially unchanged. However, the down-flowing fluid temperature outward from the inner tubing wall (line 15 shown dotted) has decreased when compared to the solid line 14 due to the loss of heat from the skin effect heater.

At another location within the alternative configuration unit, the skin effect heater may increase the inner tubing wall temperature, especially if the temperature differences between streams are small. This increased wall temperature may decrease the heat transferred from the upcoming stream to the downflowing stream. Thus, product stream heat that would have been recovered by the incoming feed stream can be lost. This unrecovered heat would typically be supplied by the skin effect heater, but combustion heat (i.e., oxygen supply) may also be increased to make up for this loss.

As shown in FIGS. 1 and 2, a typical process for using the improved Geotreater TM device involves preheating the viscous feed stream in conjunction with thermal recovery methods and pumping the preheated feed stream into the annulus 8 of unit 3. Oxygen piping 4 is proximate to the annulus 8. The heat exchanger and skin effect heater(s) continue to directly heat the downflowing feed stream by first and second quantities "Q1" and "Q2" until specific reaction start temperatures and pressures of the feed stream are achieved near the bottom. Only an amount of pressurized oxygen or oxidizer mixture is supplied, preheated, mixed and reacted near the bottom of the unit to generate a desired amount of combustion product(s). In small amounts, typical combustion products assist in the transportability (reducing the viscosity of the mixture) of the product stream, but require removal if excess amounts are present. This desirable amount of combustion, based upon combustion product desired, typically produces insufficient make-up heat to raise the regeneratively heated feed stream to the desired viscosity reduction temperature.

The improved Geotreater TM allows preheating during start-up, warm or hot storage of feed fluids during temporary shutdown or storage, and simplified maintenance and clean out due to reduced coking. The skin effect heater installation is inherently safe around the hydrocarbon fuels due to the grounded piping/tubing, low voltage and overheating controls, and gradualness of the heating.

The addition of a skin effect heater also allows the unit to be modified to be placed into a producing well, upgrading downhole produced fluids. The modifications provide a port in the outer tubing into which viscous hydrocarbons or other formation fluids present in the borehole can enter and mix with the down-coming feed stream. The heated streams within the unit are less dense and therefore the hydraulic pressure within the unit at depth is reduced, so that formation fluids under higher pressure at the same depth, can enter through the port and mix with the down-flowing feed stream. The skin effect heater can provide additional heat to the mixed or to be mixed streams to maintain pressure and temperature conditions suitable for viscosity reduction of the mixed streams downhole.

The amount of heat supplied by the skin effect heater varies depending upon the amount of combustion products needed, heat exchange efficiencies and the amount of heat needed to attain the viscosity reduction conditions. Assuming comparable thermal losses with and without a skin effect heater, the heat added by the skin effect heater is only a function of the reduction in oxidizer and combustion heat addition. In the preferred embodiment, the heat exchange between the product and feed streams is nearly unaffected by the skin effect heater, and by a simple increase in voltage/current, an increased heat input is available and controllable to exactly match the variable requirements.

Although the maximum amount of heat that can be generated by a skin effect heater is essentially unlimited, practical (e.g., cost) considerations limit the amount per unit length of tubing to relatively small amounts, when compared to the amounts that can be economically transferred by the heat exchanger. Usual amounts of heat transferred are in the order of 1-2 BTU/foot/minute. Practical limitations on voltage (approximately 5 kilovolts) do not appear to restrict the length of the skin effect heater in this application (e.g., voltage is sufficient to supply a system up to about 5 miles deep). This type of trim control heater and power supply would be capable of raising the temperature of a throughput of 250 bbl/day (approximately 27.6 liters/minute) of a bitumen by approximately 149° C. (300° F.), with nearly linearly decreasing temperature increases for increasing amounts of throughput.

In order to control the process, measurements and calculation of process conditions are required. The stream flow and properties must be measured/estimated so that the added heat required after reduced (to reduce combustion products) combustion can be supplied before combustion. Combustion is controlled to generate combustion product, the skin effect heating is controlled to make up the difference in heat required. The combination separately controls and generates the combustion products and heat necessary to achieve viscosity reduction conditions in the feed stream within a viscosity reduction zone. The zone conditions may also be maintained and/or extended by the skin effect heater.

Control logic for the various skin-effect heater, flow rate and oxidizer supply/reaction measurement and controls can be supplied by human interaction and manual actuation or by means of a microprocessor. A microprocessor can calculate a portion of the heat energy released during oxidizer reaction/combustion and the corresponding amount of combustion products generated. The microprocessor can signal control(s) to reduce the oxidizer supply to generate reduced quantities of combustion products and increase the skin effect heater output to be commensurate with the calculated heat energy lost by the reduced combustion.

Still other alternative embodiments are possible. These include: adding or extending the skin effect heater downstream of the unit in order to maintain the product stream above ambient temperature during stabilization or subsequent processing, such as at molten sulfur sulfur recovery facilities; providing a separate (i.e., not oxygen piping) small diameter piping string to interact with the alternating field produced by the copper wire and act as separate heat tracing for a portion of the unit (e.g., to minimize oxygen preheating); combining the skin effect heater in series with an electrical resistance heating element at specific locations where added heat is needed (e.g., high thermal loss zones or burning away deposits at oxygen injectors); placing a modified unit into a producing well to directly treat the produced fluid (having skin effect heaters and combustion sufficient to produce downhole thermal cracking and reduce viscosity); and having a skin effect heater attached to a liner or casing to compensate directly for thermal losses to the formation. The invention satisfies a need to treat heavy crude oil or other viscous hydrocarbons for long distance transport by pipeline. The feed stream viscosity is essentially unlimited, but practical considerations limit the viscosity of the feed stream to values which allow reasonable pumping costs. A typical heavy crude at ambient temperature can have a viscosity of more than 4,000 centipoise. Although product stream viscosities of 13 centipoise have been achieved using a Geotreater TM, a reduction to viscosities which allow reasonable pumping and transport (e.g., hundreds of centipoise at ambient temperature) are acceptable. The improved Geotreater TM can reduce the previous need for excess combustion product removal. One embodiment of the improvement adds only an insulated copper wire and power supply to convert existing oxygen piping into a multi-functional element, functioning as an easily controlled feed heater, an oxygen preheater, an oxygen supply conduit, and an oxygen stream control means.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for producing a pipeline transportable product stream from a high viscosity, combustible feed stream, said method comprising:

a. downwardly flowing said feed stream, wherein pressure is increasing as said feed stream flows towards the bottom of a subterranean cavity; and b. heating said feed stream to a temperature sufficient to product said transportable product stream at a location near the bottom of said cavity, said heating comprising:

exchanging heat from said product stream to said feed stream within a heat exchanger, heating said feed stream;

make-up heating said feed stream from a source other than said product stream and an oxidizing reaction, wherein at least a portion of said make-up heating is accomplished within said heat exchanger during said exchanging heat step, wherein said heating and make-up heating steps result in a preheated stream; and reacting said preheated stream with an oxidizer stream.

2. A method for producing a pipeline transportable product stream from a combustible feed stream, said method comprising:

a. flowing said feed stream downwardly through an indirect subterranean heat exchanger and transferring heat from said product stream to said feed stream;

b. heating said feed stream by an energy source other than said product stream and an oxidizing reaction, wherein at least part of said heating is accomplished in conjunction within said heat exchanger; and c. reacting said heated feed stream with an oxidizer stream near the bottom of said heat exchanger.

3. A method for upgrading a crude oil feed to product a lower viscosity oil product, said method comprising:

a. introducing said feed into a well having a generally closed bottom, and flowing said feed towards said bottom;

b. exchanging heat from the product to the feed in a heat exchanger;

c. additionally heating said feed using a non-combustion source of heat, wherein said additional heating is at least in part accomplished during said exchanging heat step; and d. mixing and at least partially reacting said at least partially heated feed with a quantity of an oxidizer near said bottom capable of upgrading the feed to said lower viscosity product.

4. In a method for upgrading a combustible, viscous feed to product a lower viscosity product, said method using an oxidizing fluid and a subterranean cavity having a generally closed bottom, wherein said feed is:

a. introduced into said cavity and flowed towards said bottom;

b. first heated by said lower viscosity product in a heat exchanger within said cavity; and c. mixed and at least partially reacted with a quantity of said oxidizing fluid near said bottom sufficient to produce a reaction heat quantity and a reaction product quantity which upgrades said feed to said lower viscosity product, wherein the improvement comprises:

second heating of said feed, said heating at least in part concurrent with said first heating and within said heat exchanger from a source other than an oxidizing reaction with said product stream; and reducing said quantity of said oxidizing fluid so as to reduce said reaction production quantity.

5. The method of claim 4 wherein said second heating step is accomplished by a skin-effect heater during at least a portion of said first heating step.

6. The method of claim 5 wherein said oxidizer quantity reducing step also results in a reduced reaction quantity of heat and said second heating step transfers a second quantity of heat to said feed which is commensurate with the difference between said reaction heat quantity and said reduced reaction heat quantity.

7. The method of claim 6 wherein said improvement also comprises:

calculating a portion of the reaction heat quantity generated in forming at least part of said reaction product quantity not required to produce said lower viscosity product; and controlling the quantity of said second heating to essentially equal said portion of reaction heat quantity.

8. The method of claim 7 wherein said feed is a stream supplied and pressurized by means of feed source, a feed pump and piping connecting said cavity, pump, and said source, wherein said improvement also comprises:

heating said piping by means of a skin effect heater capable of a first preheating said feed stream; and second preheating of said feed stream by means of a pump heater.

9. The method of claim 4 wherein said oxidizing fluid is supplied to said cavity by means of oxidizer piping and at least a portion of said heat exchanger and oxidizer piping form at least part of said skin-effect heater, wherein said second heating is accomplished during at least a portion of said first heating.

10. The method of claim 9 wherein said second heating step also reduces said the quantity of first heating by an incremental part, said improvement also comprising the steps of:

increasing the quantity of said second heating commensurate with said incremental part; and third heating of said stream after said reacting step.

11. The method of claim 10 wherein at least a portion of said third heating is also accomplished by means of said skin-effect heater.

12. The method of claim 11 wherein said improvement also comprises the step of pumping the lower viscosity product within a pipeline in the absence of further treatment.

13. The method of claim 11 wherein said improvement also comprises the steps of:

stabilizing the lower viscosity product; and pumping the stabilized product within a pipeline in the absence of further treatment which reduces the viscosity of said product.

14. The method of claim 13 wherein said stabilizing also comprises the steps of:

removing excess water; and removing excess gas to produce a stabilized product.

15. The method of claim 14 wherein said improvement also comprises the step of pumping the stabilized product within a pipeline in the absence of further treatment.

* * * * *